United States Patent [19]

Worthington

[11] 3,948,512

[45] Apr. 6, 1976

[54] RECREATIONAL FACILITY

[75] Inventor: Everett E. Worthington, Honolulu, Hawaii

[73] Assignee: Tennis in the Round, Inc., Honolulu, Hawaii

[22] Filed: Dec. 4, 1974

[21] Appl. No.: 529,369

[52] U.S. Cl. ..... 272/3; 273/29 A

[51] Int. Cl.[2] ..... A63C 19/00

[58] Field of Search .... 272/3, 1 R; 273/95 H, 29 A, 273/29 R, 30, 1 R, 176 E, 176 G, 176 H, 31

[56] References Cited

UNITED STATES PATENTS

| | | | |
|---|---|---|---|
| 1,818,749 | 8/1931 | Pittler | 273/176 G |
| 1,870,536 | 8/1932 | Vaccaro, Jr. | 273/176 G |
| 2,087,575 | 7/1937 | Littell et al. | 273/29 A |
| 3,858,880 | 1/1975 | Graves | 273/29 A |

FOREIGN PATENTS OR APPLICATIONS

| | | | |
|---|---|---|---|
| 349,816 | 6/1931 | United Kingdom | 273/176 G |
| 652,666 | 11/1939 | France | 273/1 R |
| 849,918 | 8/1939 | France | 273/1 R |

*Primary Examiner*—Richard J. Apley
*Assistant Examiner*—T. Brown
*Attorney, Agent, or Firm*—Cahill, Sutton & Thomas

[57] ABSTRACT

A recreational facility is described incorporating a plurality of tennis courts positioned in an array with the center lines or longitudinal axes of the courts emanating from a common point. The center lines of adjacent courts are positioned at an angle such that the boundary lines of the second halves of the courts overlap. An automatic ball-throwing machine is positioned in the second half of each of the courts to propel tennis balls to the first half; the second half of each of the courts is graded and provided with a trough to urge the balls to return to the machine. The recreational facility is also provided with a service area which is surround by the tennis courts; the second half of each tennis court is abutting the service area to provide the boundary of the service area.

3 Claims, 4 Drawing Figures

RECREATIONAL FACILITY

The present invention pertains to a recreational facility, and more particularly to an array of tennis courts that are used as practice courts.

One of the criteria for achieving proficiency in the game of tennis is practice; further, it is important that the practice be accomplished as nearly in the environment of a game as possible. Unfortunately, beginners are not sufficiently proficient to obtain significant advantages from attempting to play games with other beginners; therefore, it is necessary for a more skilled player, or an instructor, to assist the beginner so that the latter may become accustomed to the environment of tennis and become proficient at serving and appropriately returning the ball. Practice sessions with an instructor or a more skilled player can become tedious and time consuming since the beginner seldomly has proficiency to maintain a volley of significant length.

As the beginner becomes more proficient, his skill can only be significantly enhanced by becoming involved in vollies and experiencing actual court environment for the use of various strokes. Once again, an instructor or a more skilled player is required, which again becomes time consuming. In any case, a substantial length of time is spent retrieving tennis balls. If the person playing the less skilled player is an instructor, the practice session can be expensive for the latter; if the person replacing the instructor is simply a more skilled player, the practice session is time consuming, boring and of no value to the more skilled player.

Even highly skilled and professional players require someone of equal skill to play before the games become substantially instructive; further, repeated practice of desired maneuvers is impossible since the ball will seldomly be returned repeatedly in the same fashion to permit continued use of a desired maneuver or stroke.

Facilities for practicing tennis without the aid of an instructor or an opponent are limited to the use of backstops, wherein the player attempts to volley the ball against the backstop (obviously with sufficient accuracy to be able to continue to strike the ball with the stroke being practiced, e.g., backhand).

It is therefore an object of the present invention to provide a recreational facility incorporating tennis courts having means for beginners and skilled players alike to practice without an opponent or instructor.

It is another object of the present invention to provide a recreational facility utilizing practice tennis courts to permit players to practice their skills without the use of a backstop and without an opponent or instructor.

It is still another object of the present invention to provide a recreational facility incorporating practice tennis courts which courts may be situated in an array less than the sum of the areas of the individual courts.

These and other advantages of the present invention will become apparent to those skilled in the art as the description thereof proceeds.

Briefly, in accordance with the embodiment chosen for illustration, a plurality of tennis courts are positioned adjacent to one another with the court center lines forming radials emanating from a common point. The courts are each provided with a mid-court net extending transversely of the center lines to divide the courts into first and second halves. The first half of each of the courts is the radially outwardly positioned half while the second half of the court is the radially inwardly extending half which extends toward the point from which the center line emanates. The courts are provided with the usual regulation boundary lines (for singles and doubles play) and the boundary lines on the second half on each of the courts overlaps the boundary lines of the second half of each of the adjacent courts.

The second half of each of the courts is provided with an appropriate slope and a trough or channel such that loose tennis balls roll into the trough and are thus urged to a collection point. A ball throwing machine is positioned near the collection point in each of the second halves of the courts and propels the tennis balls to the first half of the corresponding court.

The present invention may more readily be described by reference to the accompanying drawings in which.

Figure 4:
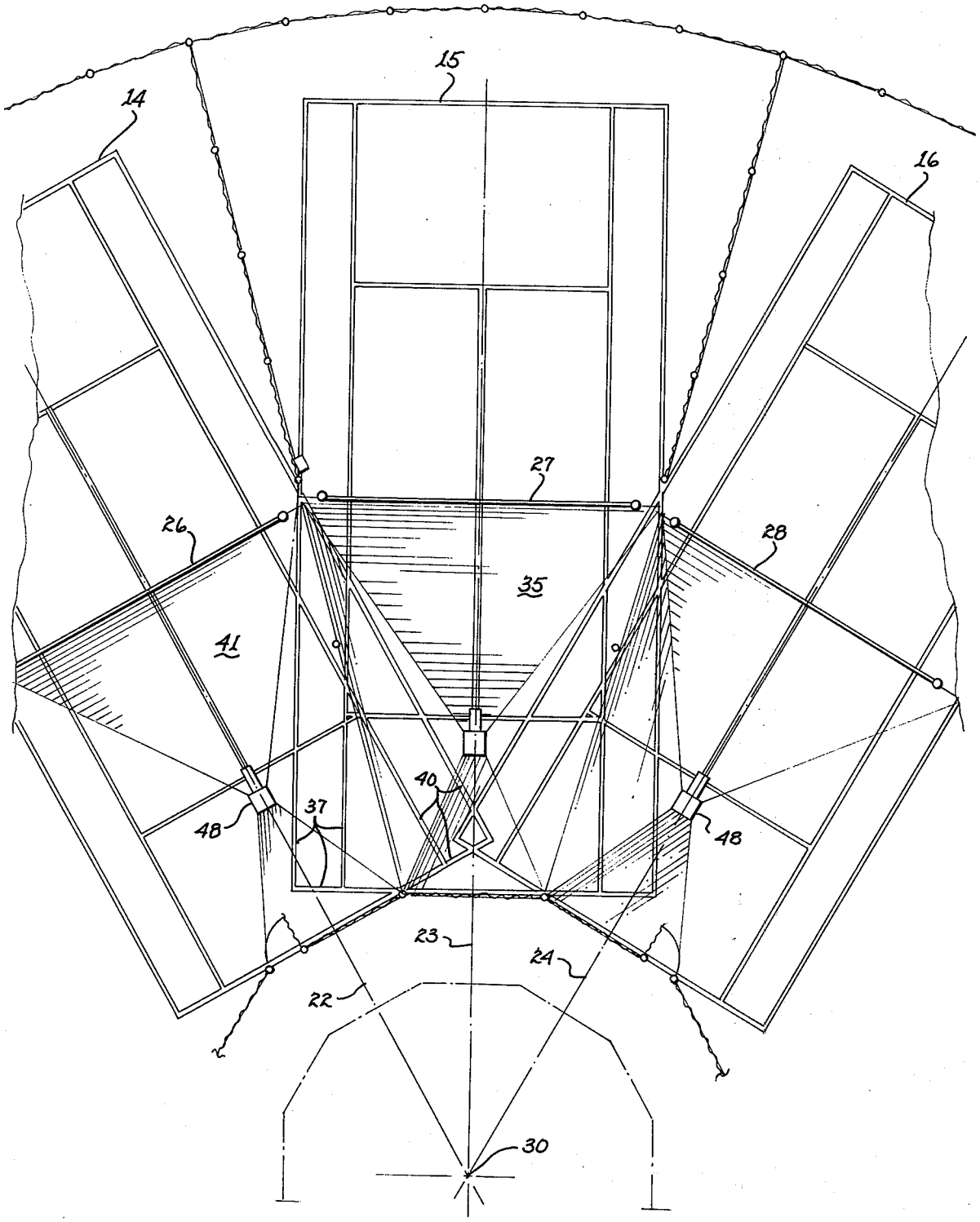
FIG. 4 is a plan view, enlarged, of a portion of the recreational facility of FIG. 1.

Referring now to the drawings, an array of tennis courts, such as courts 10, 11, 12–20, are positioned in an array. Each of the tennis courts is of regulation rectangular shape having a longitudinal axis or center line (such as those shown at 22,23 and 24 in FIG. 4) and boundary lines defining regulation singles and doubles play areas. Each court is provided with a mid-court net (such as those shown at 26, 27 and 28 in FIG. 4) extending transversely of the longitudinal axis or center line of the respective courts to divide the court into a first half and a second half.

Figure 1:
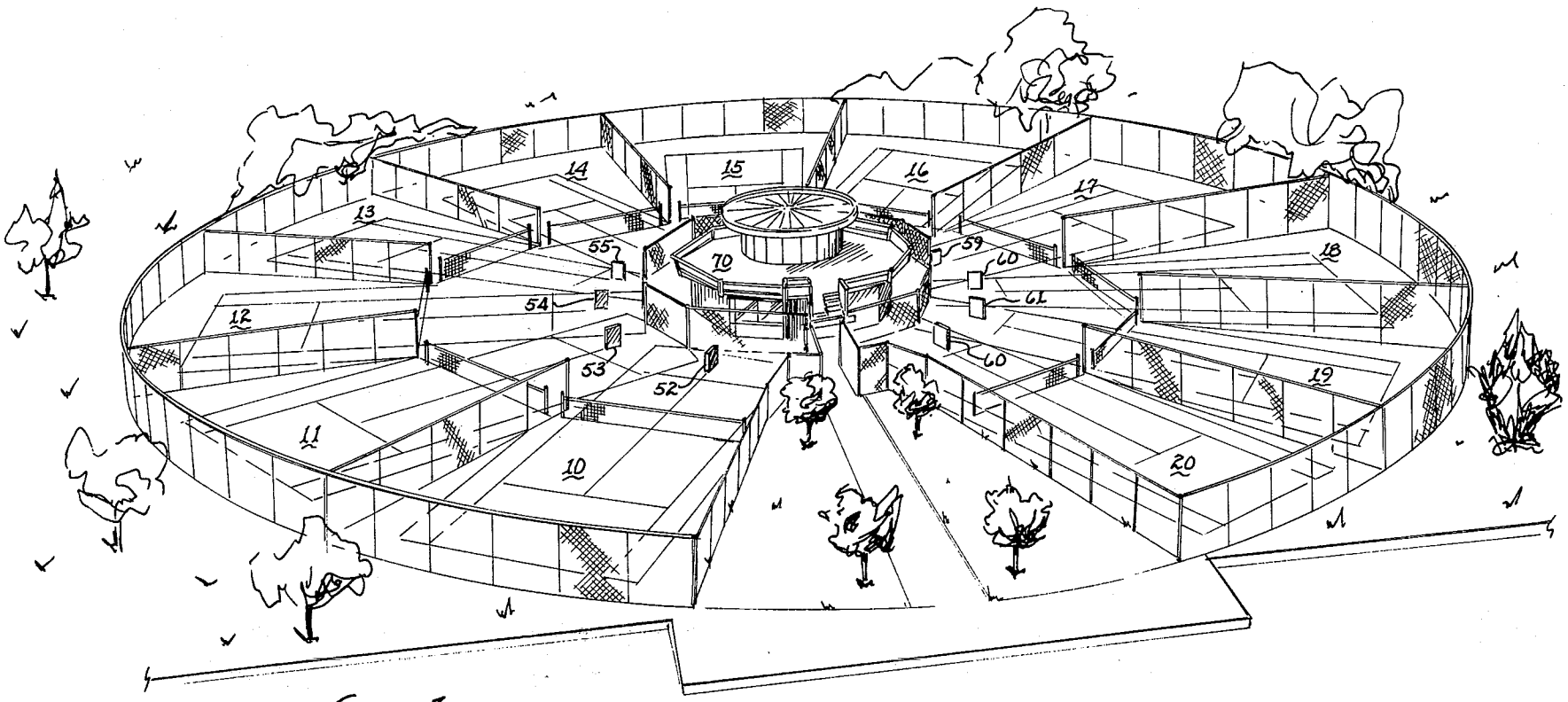
FIG. 1 is a prospective view of a recreational facility constructed in accordance with the teachings of the present invention.
Figure 2:
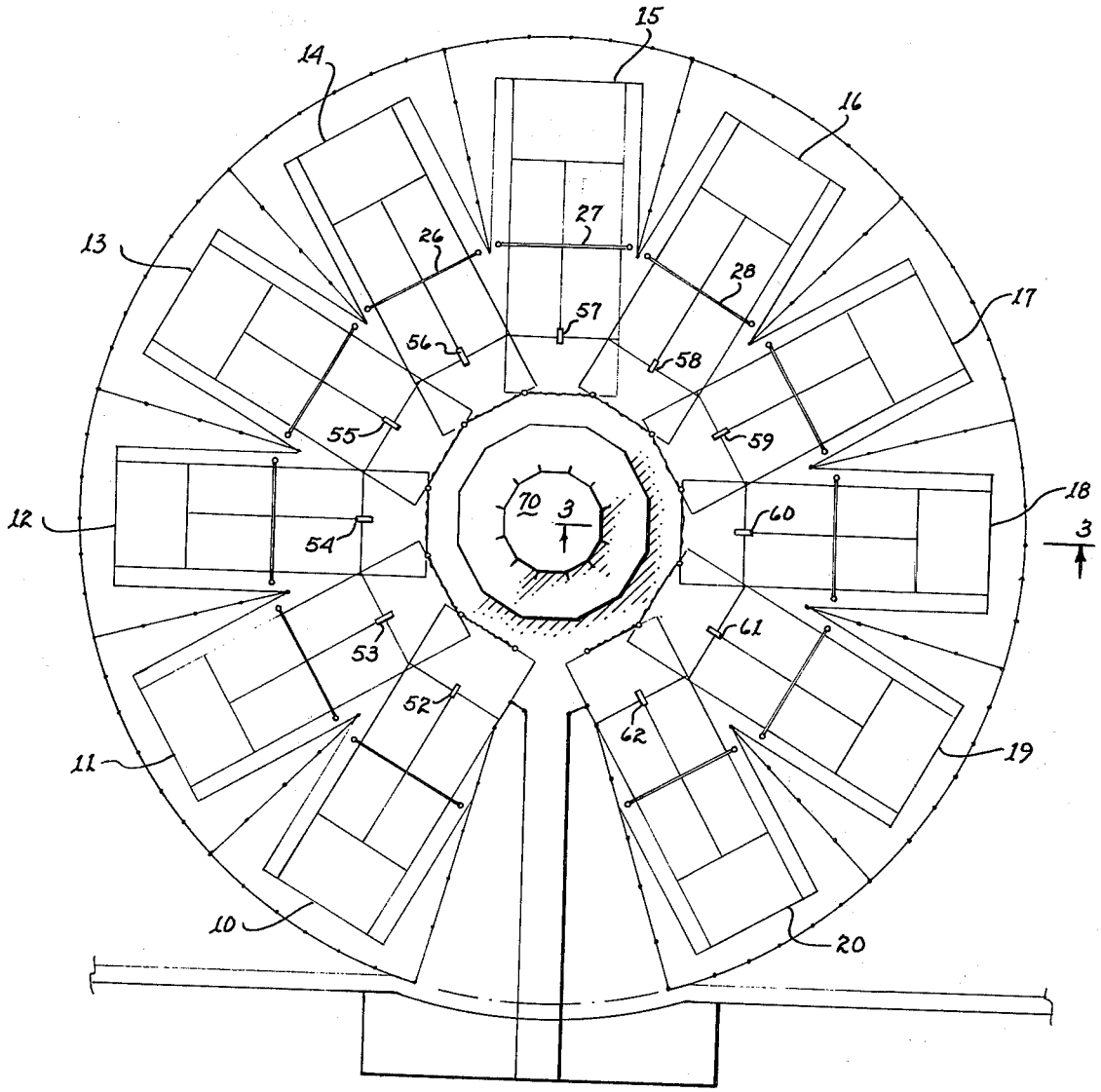
FIG. 2 is a plan view of the facility of FIG. 1.
Figure 3:
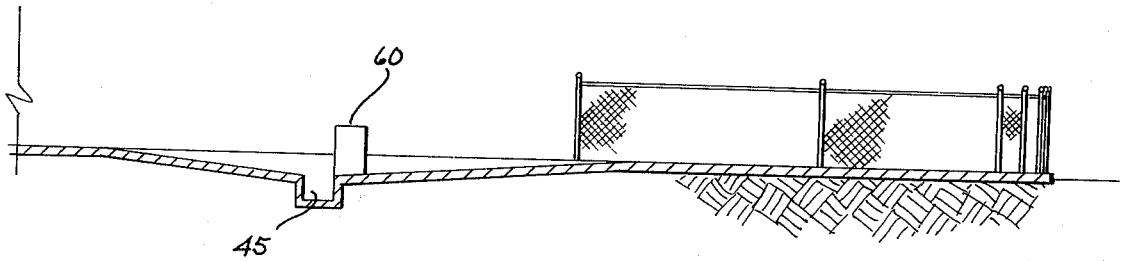
FIG. 3 is a cross-sectional view of a portion of FIG. 2 taken along line 3—3.

The longitudinal axis or center line of adjacent courts such as center lines 22,23 and 24 are positioned at an angle with respect to each other. In the embodiment chosen for illustration the center lines form radials emanating from a point 30; however, it will be obvious to those skilled in the art that the angular relationship among the center lines need not be such that the center lines form radials. The second half of each of the courts, such as the half 35 of the court 15, includes boundary lines 37 which overlap or cross over the the boundary lines 40 of the second half 41 of adjacent courts such as court 14. It may, therefore, be seen that the first half of each of the courts appears conventional in that it is unobstructed and is of regulation size bounded by conventional boundary lines and the mid-court net; however, the second half of each of the courts partially overlaps the second half of each adjacent court and is, therefore, nonconventional. The surface of the first half of each of the courts may be conventional, (i.e. flat, hard surface or turf) while the second half of each of the courts is appropriately graded and provided with a suitable slope, as shown in FIG. 3, to cause the loose balls to roll by gravity to a channel or trough 45. The troughs 45 are also sloped to result in the collection of the loose tennis balls at collection points or areas 48.

A plurality of tennis ball throwing machines 52–62 are each positioned in a second half of one of the courts 10–20 and are appropriately placed to accept the tennis balls received by the collection areas 48. The tennis ball propelling machines are of conventional design and are quite similar to ball throwing machines utilized for baseball batting practice. Such machines are well developed and known in the art and need not be described in detail.

The recreational facility incorporating the practice tennis courts shown in the embodiment chosen for illustration is formed by a circular array of tennis courts with the second halves of each of the courts partially overlapping. The center portion 70 of the tennis court area may be used for a service area such as club facilities, restaurant, pro shop, observation platform, and the like.

In practice, a player may practice (singles or doubles) by conventionally positioning himself on the first half of a selected court. Tennis balls will then be propelled from the corresponding machine over the mid-court net at a predetermined velocity and direction to permit the player or players to repeatedly practice a desired maneuver and stroke; alternatively, the machine can be adjusted to provide a variety of ball deliveries, both fast and slow, to a variety of positions in the first half of the court. In this manner the player can obtain experience and practice commensurate with his present skill to more efficiently achieve greater proficiency. Even in those instances where a beginner is to be coached by an instructor, the instructor can take the position near the collection area and continuously deliver the ball to the beginner on the first half of the court without the need to interrupt the practice session to retrieve balls. It may be seen that the present invention provides a recreational facility having a plurality of tennis courts arranged in an array that is compact and occupies less than the area of the sum of the areas of the courts. Even though the total area of the facility required to be surface or prepared for the courts is less, each court is nevertheless provided with the regulation area so that the players are each provided with the benefit of striking the ball into a full size court.

The effective "sharing" of the second halves of each of the courts does not interfere with players since they occupy only the first half of each of the courts which provides them an area in which to maneuver identical to a conventional tennis court. In practice, the boundary lines of adjacent courts may be color coded to facilitate the detection of the appropriate boundary lines of each of the courts.

I claim:

1. A recreational facility comprising: a curved array of rectangular tennis courts positioned about a service area and adjacent one another, each of said courts having a longitudinal axis, a rectangular boundary line unique to that court, and a mid-court net extending transversely of said longitudinal axis to divide said court into first and second halves; each of said longitudinal axes positioned at an angle of less than 90° with respect to the longitudinal axis of adjacent courts, the rectangular boundary line of each court on the second half of the court, overlapping the rectangular boundary line on the second half of an adjacent court; said second half of each court having a portion unique to that court and a portion overlapping the second half of each adjacent court, said second half of each of said courts abutting said service area.

2. The combination set forth in claim 1 wherein each of said longitudinal axes are positioned on a radial line extending from a point.

3. The combination set forth in claim 1 including a plurality of ball throwing means each for propelling tennis balls over a different one of said mid-court nets to the first half of each of said courts.

* * * * *